US007876044B2

(12) United States Patent
Kim

(10) Patent No.: US 7,876,044 B2
(45) Date of Patent: Jan. 25, 2011

(54) PLASMA DISPLAY APPARATUS HAVING AN EXTERNAL LIGHT SHIELD

(75) Inventor: Hong Tak Kim, Taegu-si (KR)

(73) Assignee: LG Electronics Inc., Seoul (KR)

( * ) Notice: Subject to any disclaimer, the term of this patent is extended or adjusted under 35 U.S.C. 154(b) by 1093 days.

(21) Appl. No.: 11/604,872

(22) Filed: Nov. 28, 2006

(65) Prior Publication Data

US 2007/0120485 A1 May 31, 2007

(30) Foreign Application Priority Data

Nov. 29, 2005 (KR) ..... 10-2005-0114893

(51) Int. Cl.

| | |
|---|---|
| ***H01J 17/49*** | (2006.01) |
| ***H01J 1/62*** | (2006.01) |
| ***H01J 63/04*** | (2006.01) |
| ***H01J 1/52*** | (2006.01) |

(52) U.S. Cl. ..... 313/582; 313/494; 313/313

(58) Field of Classification Search ..... 313/581–587
See application file for complete search history.

(56) References Cited

U.S. PATENT DOCUMENTS

| | | | | |
|---|---|---|---|---|
| 6,657,387 | B1 | 12/2003 | Yoo | 313/587 |
| 2004/0164661 | A1 | 8/2004 | Kim et al. | 313/112 |
| 2005/0068267 | A1 | 3/2005 | Yoshioka et al. | 345/60 |
| 2005/0093776 | A1 | 5/2005 | Furutani et al. | 345/60 |
| 2006/0033436 | A1* | 2/2006 | Sano et al. | 313/583 |
| 2006/0250064 | A1* | 11/2006 | Park et al. | 313/112 |
| 2007/0075641 | A1* | 4/2007 | Yu | 313/587 |

FOREIGN PATENT DOCUMENTS

| | | |
|---|---|---|
| CN | 1286460 | 3/2001 |
| EP | 1 471 559 A1 | 10/2004 |

OTHER PUBLICATIONS

European Search Report dated Jan. 16, 2008.
Chinese Office Action dated Mar. 14, 2008.

* cited by examiner

*Primary Examiner*—Toan Ton
*Assistant Examiner*—Britt D Hanley
(74) *Attorney, Agent, or Firm*—KED & Associates, LLP

(57) ABSTRACT

Provided is a plasma display apparatus. The plasma display apparatus includes a scan electrode and a sustain electrode, a boundary barrier rib, and a filter. The scan and sustain electrodes are formed in parallel with each other on a front substrate. The boundary barrier rib is formed on a rear substrate facing the front substrate, and partitions a discharge cell into two up/down neighbor cells. The filter is positioned in front of a panel. The filter includes an external light shield sheet including a first base part and a first pattern part, and an ElectroMagnetic Interference (EMI) shield sheet. A thickness of the external light shield sheet is 1.01 to 2.25 times of a height of the first pattern part. The sustain electrode is commonly formed only one for the two up/down neighbor cells.

14 Claims, 15 Drawing Sheets

PLASMA DISPLAY APPARATUS HAVING AN EXTERNAL LIGHT SHIELD

This Nonprovisional application claims priority under 35 U.S.C. §119(a) on Patent Application No. 10-2005-0114893 filed in Korea on Nov. 29, 2005, the entire contents of which are hereby incorporated by reference.

BACKGROUND OF THE INVENTION

1. Field of the Invention

The present invention relates to a plasma display apparatus, and more particularly, to a plasma display apparatus for shielding external light, thereby improving contrast, and preventing cross-talk between two neighbor cells, thereby preventing erroneous discharge and reducing power consumption, and increasing an aperture ratio of a cell, thereby improving luminance.

2. Description of the Background Art

Plasma Display Panel (PDP) refers to a device for applying a predetermined voltage to electrodes installed in a discharge space, inducing discharge, and exciting phosphors by plasma generated by gas discharge, thereby displaying an image including a character or a graphic. The plasma display panel has an advantage of facilitating large-sizing, lightweighting, and thinning, providing a wide viewing angle in omnidirection, and realizing a full color and a high luminance.

In a conventional electrode structure of a plasma display apparatus, there are two arrangement types of YZYZ and YZZY of a scan electrode (Y) or a sustain electrode (Z) formed on a front substrate, on the basis of two neighbor cells.

The conventional YZYZ type electrode structure can cause cross-talk between the neighbor cells.

In detail, in case where electrodes provided left and right of a boundary barrier rib between the neighbors cells are positioned close to an electrode of a neighbor cell, they can influence the discharge, and induce erroneous discharge.

In the conventional YZYZ type electrode structure, a voltage difference between the electrodes of the neighbor cells results in a parasitic capacitance at the boundary barrier rib between the two neighbor cells. This increases a capacitance between the neighbor cells, serving as a disadvantage in wall charge formation and power consumption in view of driving the panel.

In the conventional YZZY type electrode structure, there occurs reduction of luminance due to a luminance difference between electrode lines. This results from a difference between a discharge intensity of the Y electrode and a discharge intensity of the Z electrode. The Y electrode takes part in reset, inducing a higher discharge than the Z electrode.

Accordingly, the conventional YZZY type electrode structure has a drawback that luminance value is not uniform on the whole since the luminance is high in a successively arranged Y-electrode portion, and is low in a successively arranged Z-electrode portion.

The conventional plasma display apparatus has a drawback that external incident light is reflected, thereby causing a poor definition picture and a reduction of contrast.

SUMMARY OF THE INVENTION

Accordingly, the present invention is to solve at least the problems and disadvantages of the background art.

The present invention is to provide a plasma display apparatus for sharing one sustain electrode between two neighbor cells, thereby reducing a panel capacitance and reducing power consumption, and widening an opening portion of a cell, thereby improving a luminance characteristic, and shielding external light, thereby improving contrast.

To achieve these and other advantages and in accordance with the purpose of the present invention, as embodied and broadly described, there is provided a plasma display apparatus. The plasma display apparatus includes a scan electrode and a sustain electrode, a boundary barrier rib, and a filter. The scan electrode and the sustain electrode are formed in parallel with each other on a front substrate. The boundary barrier rib is formed on a rear substrate facing the front substrate, and partitions a discharge cell into two up/down neighbor cells. The filter is positioned in front of a panel formed by combining the front substrate with the rear substrate. The filter includes an external light shield sheet including a first base part and a first pattern part formed on the first base part, and an ElectroMagnetic Interference (EMI) shield sheet comprising a second pattern part. A thickness of the external light shield sheet is 1.01 to 2.25 times of a height of the first pattern part. The sustain electrode is commonly formed only one for the two up/down neighbor cells.

In another aspect, there is provided a plasma display apparatus. The plasma display apparatus includes a scan electrode and a sustain electrode, a boundary barrier rib, and a filter. The scan electrode and the sustain electrode are formed in parallel with each other on a front substrate. The boundary barrier rib is formed on a rear substrate facing the front substrate, and partitions a discharge cell into two up/down neighbor cells. The filter is positioned in front of a panel formed by combining the front substrate with the rear substrate. The filter includes an external light shield sheet comprising a first base part and a first pattern part formed on the first base part, and an ElectroMagnetic Interference (EMI) shield sheet comprising a second pattern part. A thickness of the external light shield sheet is 1.01 to 2.25 times of a height of the first pattern part. The scan electrode and the sustain electrode comprise bus electrodes. The bus electrode of the sustain electrode comprises a first sub electrode and a second sub electrode spaced apart a predetermined distance from each other at a center of the boundary barrier rib.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
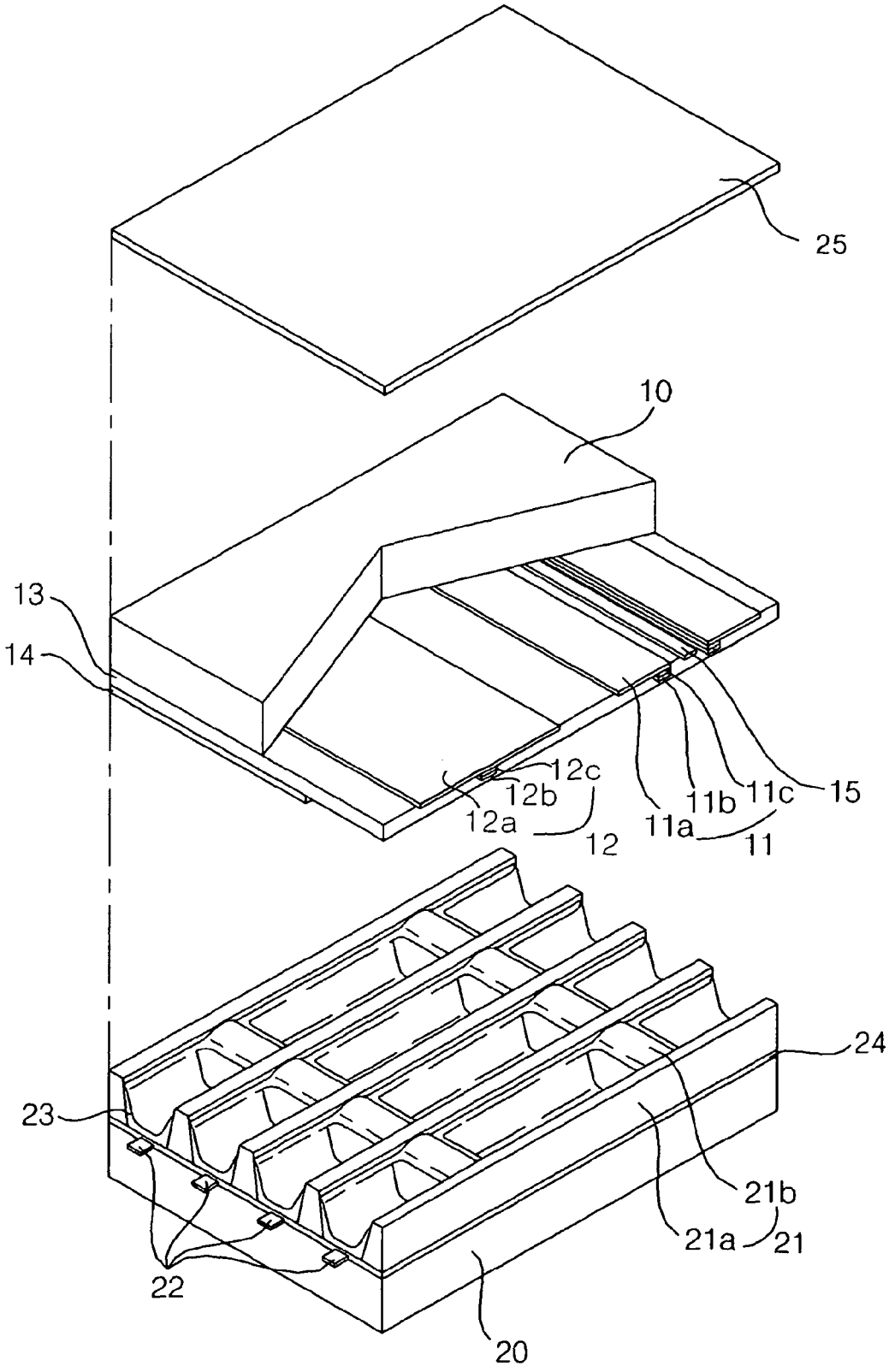
FIG. 1 is a perspective view illustrating a structure of a plasma display panel according to an exemplary embodiment of the present invention.

FIG. 1 is a perspective view illustrating a structure of a plasma display panel according to an exemplary embodiment of the present invention.

As shown in FIG. 1, the plasma display panel includes a scan electrode 11 and a sustain electrode 12 that constitute a sustain electrode pair formed on a front substrate 10; and an address electrode 22 formed on a rear substrate 20.

The sustain electrode pair 11 and 12 includes transparent electrodes 11*a* and 12*a*, and bus electrodes 11*b* and 12*b*. The transparent electrodes 11*a* and 12*a* are formed of Indium-Tin-Oxide (ITO). The bus electrodes 11*b* and 12*b* can be formed of metal such as silver (Ag) and chrome (Cr). Alternately, the bus electrodes 11*b* and 12*b* can be of laminate type based on chrome/copper/chrome (Cr/Cu/Cr) or chrome/aluminum/chrome (Cr/Al/Cr). The bus electrodes 11*b* and 12*b* are formed on the transparent electrodes 11*a* and 12*a*, and reduce a voltage drop caused by the transparent electrodes 11*a* and 12*a* having high resistances.

The sustain electrode 12 is formed one by one for two up/down neighbor cells. In detail, the sustain electrode 12 is formed in such a manner that it is shared by the two neighbor cells. Thus, an electrode structure is an YZY structure. Various embodiments thereof will be again described in detail later.

In an exemplary embodiment of the present invention, the sustain electrode pair 11 and 12 can be of structure in which the transparent electrodes 11*a* and 12*a* and the bus electrodes 11*b* and 12*b* are laminated, as well as can be of structure based on only the bus electrodes 11*b* and 12*b*, excluding the transparent electrodes 11*a* and 12*a*. Such an ITO-less structure is advantageous of reducing a panel manufacture cost because it does not use the transparent electrodes 11*a* and 12*a*. The bus electrodes 11*b* and 12*b* used for the ITO-less structure can be formed of diverse materials such as photosensitive material in addition to the above-described materials.

A Black Matrix (BM) 15 is provided between the transparent electrodes 11*a* and 12*a* and the bus electrodes 11*b* and 12*b* of the scan electrode 11 and the sustain electrode 12. The black matrix 15 performs a light shield function of absorbing external light emitting from an outside of the front substrate 10 and reducing reflection, and a function of improving purity and contrast of the front substrate 10.

In an exemplary embodiment of the present invention, the black matrix 15 is formed on the front substrate 10. The black matrix 15 can be comprised of a first black matrix 15, and second black matrixes 11*c* and 12*c*. The first black matrix 15 is formed in a position where it overlaps with a barrier rib 21. The second black matrixes 11*c* and 12*c* are formed between the transparent electrodes 11*a* and 12*a* and the bus electrodes 11*b* and 12*b*. The first black matrix 15, and the second black matrixes 11*c* and 12*c* (called black layers or black electrode layers) are concurrently formed in their forming processes, thereby physically connecting or disconnecting from each other.

The first black matrix 15 and the second black matrixes 11*c* and 12*c* are formed of same material, physically connecting with each other. However, the first black matrix 15 and the second black matrixes 11*c* and 12*c* are formed of different materials, physically disconnecting from each other.

An upper dielectric layer 13 and a protective film 14 are layered on the front substrate 10 where the scan electrode 11 and the sustain electrode 12 are formed in parallel with each other. Charged particles generated by discharge are accumulated on the upper dielectric layer 13. The upper dielectric layer 13 can protect the sustain electrode pair 11 and 12. The protective film 14 protects the upper dielectric layer 13 against sputtering of the charged particles generated by the gas discharge. The protective film 14 enhances an efficiency of emitting secondary electrons.

The address electrode 22 is formed in the direction of intersecting with the scan electrode 11 and the sustain electrode 12. A lower dielectric layer 24 and the barrier rib 21 are formed on the rear substrate 20 including the address electrode 22.

A phosphor layer 23 is formed on surfaces of the lower dielectric layer 24 and the barrier rib 21. The barrier rib 21 includes a vertical barrier rib 21*a* and a horizontal barrier rib 21*b* that are formed in a closed type. The barrier rib 21 physically distinguishes the cell, and prevents ultraviolet rays and visible rays generated by the discharge from leaking to the neighbor cells. In the present invention, a horizontal barrier rib overlapping with the sustain electrode 12 among the horizontal barrier ribs 21*b* is called a boundary barrier rib.

Referring to FIG. 1, a filter 25 is formed on an entire surface of the plasma display panel according to the present invention. The filter 25 can include an external light shield layer, an Anti-Reflection (AR) layer, a Near InfraRed (NIR) shield layer or an ElectroMagnetic Interference (EMI) shield layer.

When the filter 25 is spaced apart from the panel by an interval of about 10 μm to 30 μm, it can effectively shield light incident from the exterior, and effectively emit light generated from the panel to the exterior. In order to protect the panel against an external pressure, the filter 25 can be spaced apart from the panel by an interval of about 30 μm to 120 μm.

An adhesive layer can be formed between the filter 25 and the panel, and adhere the filter 25 to the panel. A detailed description of the filter 25 will be later made after a detailed description of the electrode structure is made.

In an exemplary embodiment of the present invention, the barrier rib 21 can have various shaped structures as well as a structure shown in FIG. 1. For example, there are a differential type barrier rib structure, a channel type barrier rib structure, and a hollow type barrier rib structure. In the differential type barrier rib structure, the vertical barrier rib 21*a* and the horizontal barrier rib 21*b* are different in height. In the channel type barrier rib structure, a channel available for an exhaust passage is provided for at least one of the vertical barrier rib 21*a* and the horizontal barrier rib 21*b*. In the hollow type barrier rib structure, a hollow is provided for at least one of the vertical barrier rib 21*a* and the horizontal barrier rib 21*b*.

It is desirable that the horizontal barrier rib 21*b* is great in height in the differential type barrier rib structure. It is desirable that the horizontal barrier rib 21*b* has the channel or hollow in the channel type or hollow type barrier rib structure.

In an exemplary embodiment of the present invention, it is shown and described that each of Red (R), Green (G), and Blue (B) discharge cells is arranged on the same line. Alternatively, the R, G, B discharge cells can be arranged in a different type. For example, there is a delta type arrangement where the R, G, B discharge cells are arranged in a triangular shape. The discharge cell can have a rectangular shape as well as a polygonal shape such as a pentagonal shape and a hexagonal shape.

The phosphor layer 23 is excited by the ultraviolet rays generated by the gas discharge, and emits any one visible ray among Red (R), Green (G), and Blue (B). An inertia mixture gas such as helium plus xenon (He+Xe), neon plus xenon (Ne+Xe), and helium plus neon plus xenon (He+Ne+Xe) is injected into a discharge space provided between the front and rear substrates 10 and 20 and the barrier rib 21.

Figure 2:
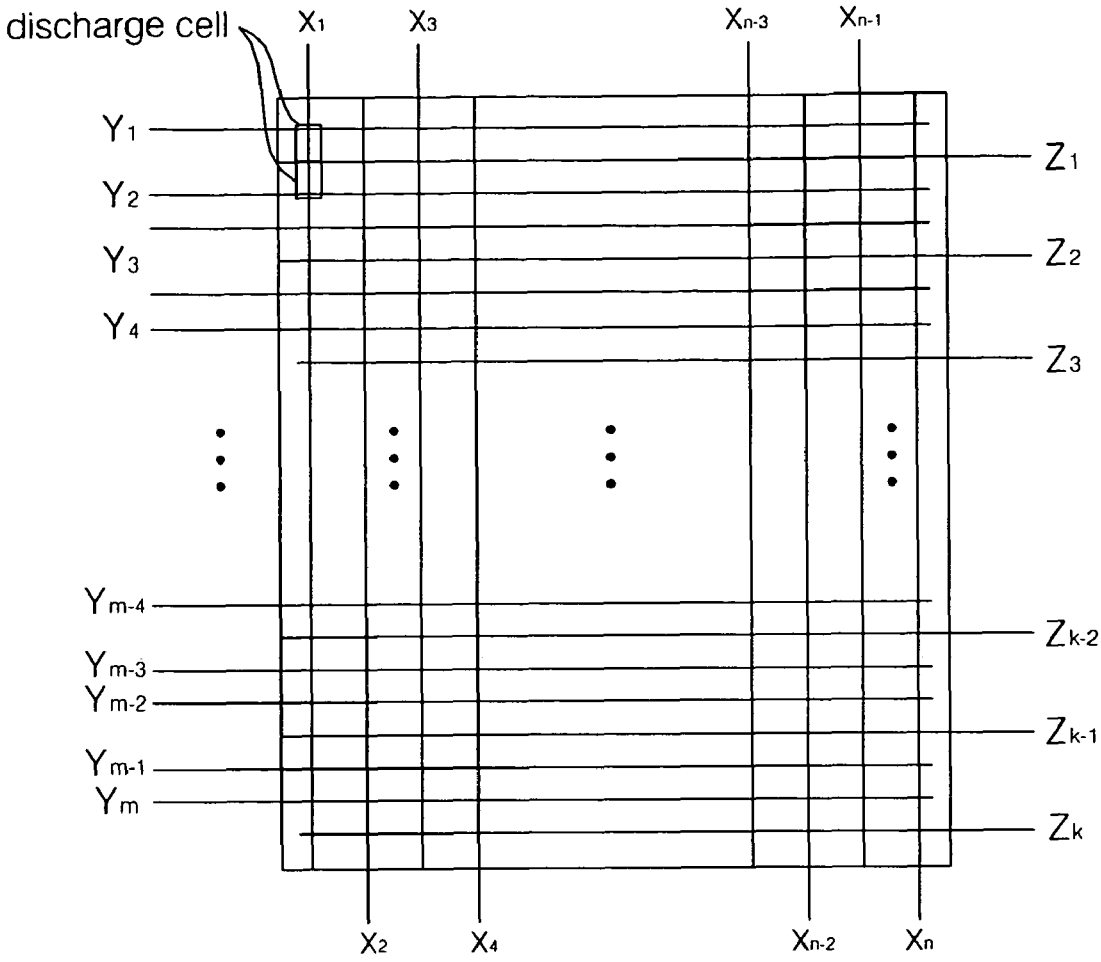
FIG. 2 is a diagram illustrating electrode arrangement of a plasma display panel according to an exemplary embodiment of the present invention.

FIG. 2 is a diagram illustrating an electrode arrangement of the plasma display panel according to an exemplary embodiment of the present invention. It is desirable that a plurality of discharge cells constituting the plasma display panel is arranged in matrix form as shown in FIG. 2. The electrode structure of the plasma display apparatus according to the present invention has a feature that a sustain electrode line (Z1 to Zk) is formed only one by one for the two neighbor cells. The plurality of discharge cells is provided at intersections of scan electrode lines (Y1 to Ym) and sustains electrode lines (Z1 to Zk), and address electrode lines (X1 to Xn), respectively. The scan electrode lines (Y1 to Ym) can be driven sequentially or simultaneously. The sustain electrode lines (Z1 to Zk) can be driven simultaneously. The address electrode lines (X1 to Xn) can be divided into odd-numbered lines and even-numbered lines and driven, or can be driven sequentially.

The electrode arrangement of FIG. 2 is merely exemplary for the plasma display panel according to the present invention. Thus, the present invention is not limited to the electrode arrangement of the plasma display panel of FIG. 2 and a driving method thereof. For example, the present invention can also provide a dual scan method for simultaneously scanning two ones among the scan electrode lines (Y1 to Ym). The address electrode lines (X1 to Xn) can be divided into upper and lower portions at a center of the panel.

Figure 3:
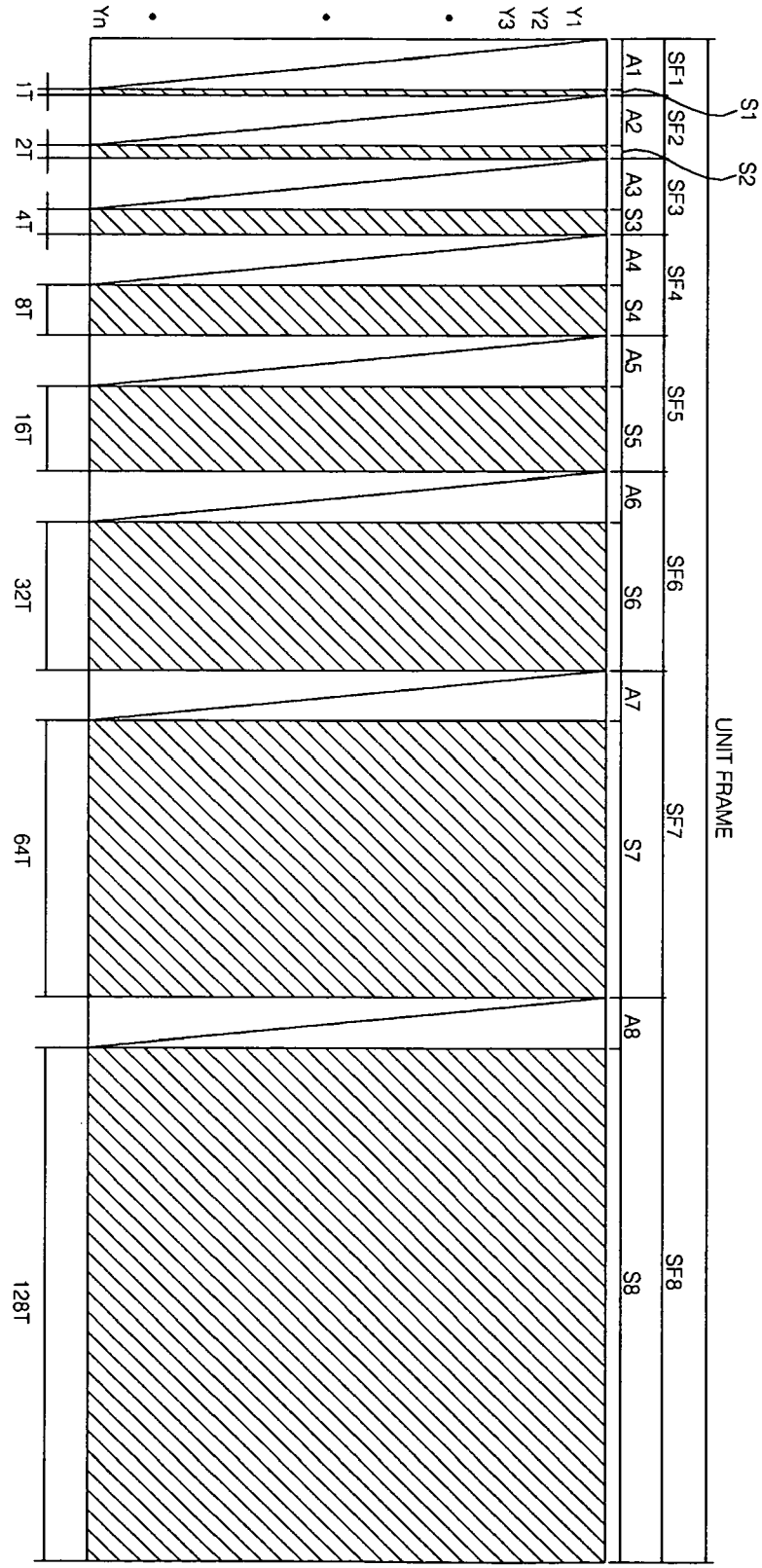
FIG. 3 is a diagram illustrating a method of time-division driving a plasma display apparatus by dividing one unit frame of an image into a plurality of subfields according to an exemplary embodiment of the present invention.

FIG. 3 is a diagram illustrating a method of time-division driving the plasma display apparatus by dividing one unit frame of an image into a plurality of subfields according to an exemplary embodiment of the present invention. The unit frame can be divided into a predetermined number of subfields, e.g. eight subfields (SF1, . . . , SF8) to realize time-division gray level display. Each subfield (SF1, . . . , SF8) is divided into a reset period (not shown), an address period (A1, . . . , A8), and a sustain period (S1, . . . , S8).

In an exemplary embodiment of the present invention, the reset period can be omitted from at least one of the plurality of subfields. For example, the reset period can exist only at a first subfield, or can exist only at the first field and an approximately middle subfield among the whole subfields.

During each address period (A1, . . . , A8), an address signal is applied to the address electrode (X), and a scan signal associated with each scan electrode (Y) is sequentially applied to one scan electrode line one by one.

During each sustain period (S1, . . . , S8), a sustain signal is alternately applied to the scan electrode (Y) and the sustain electrode (Z), thereby inducing a sustain discharge in the discharge cell having wall charges formed in the address periods (A1, . . . , A8).

In the plasma display panel, luminance is proportional to the number of sustain discharge pulses within the sustain discharge periods (S1, . . . , S8) of the unit frame. In case where one frame constituting one image is expressed by 8 subfields and 256 gray levels, the sustain signals different from each other can be assigned to each subfield in a ratio of 1:2:4:8:16:32:64:128 in regular sequence. The cells are addressed and the sustain discharges are performed during the subfield1 (SF1), the subfield3 (SF3), and the subfield8 (SF8) so as to acquire luminance based on 133 gray levels.

The number of sustain discharges assigned to each subfield can be variably decided depending on subfield weights based on an Automatic Power Control (APC) level. In detail, the present invention is not limited to the exemplary description of FIG. 3 where one frame is divided into eight subfields, and can variously modify the number of subfields constituting one frame depending on a design specification. For example, one frame can be divided into 9 subfields or more like 12 subfields or 16 subfields to drive the plasma display panel.

The number of sustain discharges assigned to each subfield can be diversely modified considering a gamma characteristic or a panel characteristic. For example, a gray level assigned to the subfield4 (SF4) can decrease by 8 to 6, and a gray level assigned to the subfield6 (SF6) can increase by 32 to 34.

Figure 4:
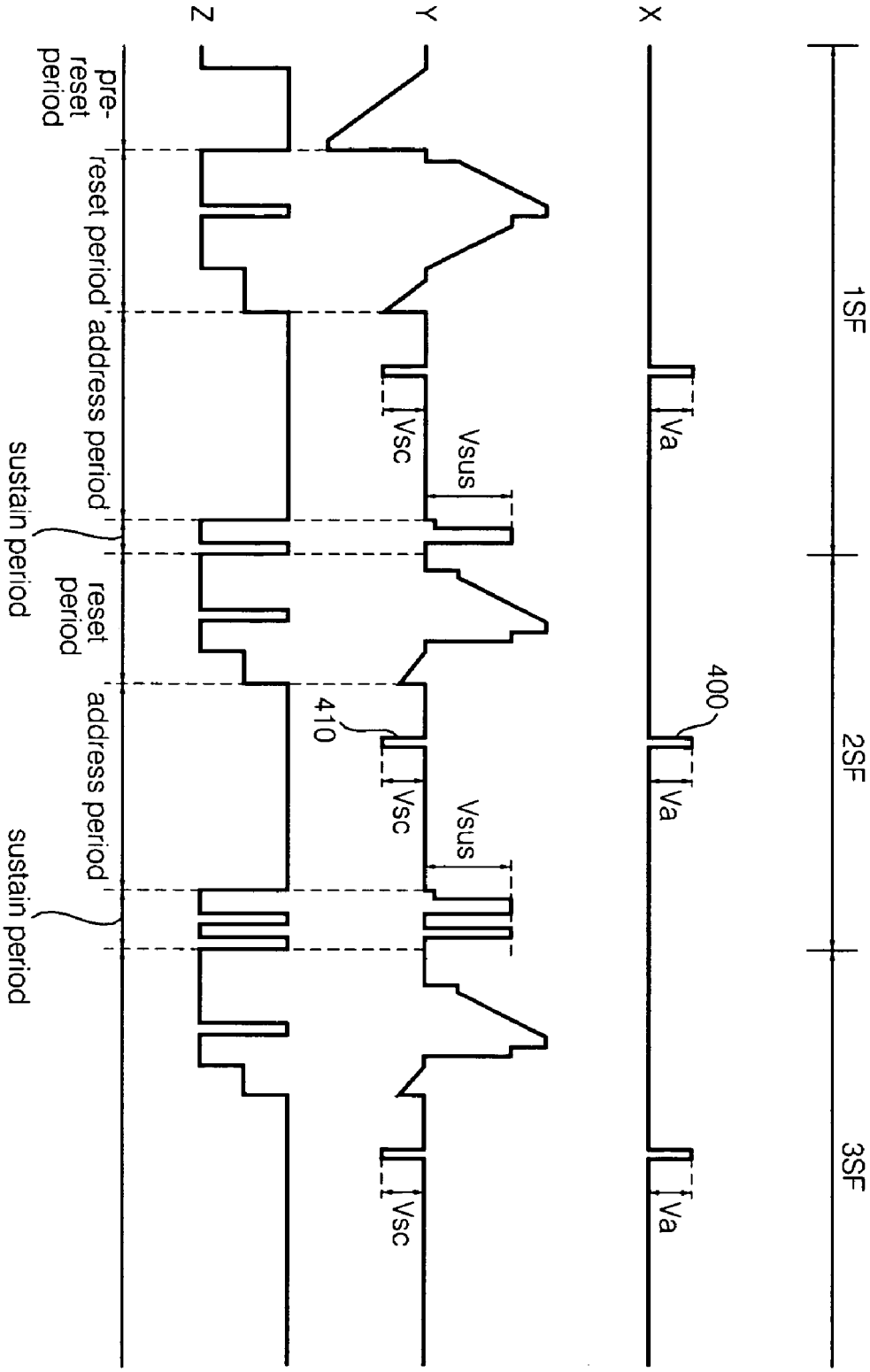
FIG. 4 is a timing diagram illustrating driving signals for driving a plasma display panel according to an exemplary embodiment of the present invention.

FIG. 4 is a timing diagram illustrating driving signals for driving the plasma display panel for one subfield according to an exemplary embodiment of the present invention.

The subfield includes a pre reset period for forming positive wall charges on the scan electrodes (Y) and forming negative wall charges on the sustain electrodes (Z); the reset period for initializing the discharge cells of a whole screen using a distribution of the wall charges formed during the pre reset period; the address period for selecting the discharge cell; and the sustain period for sustaining the discharge of the selected discharge cell.

The reset period is comprised of a setup period and a setdown period. During the setup period, a ramp-up waveform is concurrently applied to all the scan electrodes, thereby inducing a minute discharge in all the discharge cells and thus generating the wall charges. During the setdown period, a ramp-down waveform ramping down in a positive voltage lower than a peak voltage of the ramp-up waveform is concurrently applied to all the scan electrodes (Y), thereby inducing an erasure discharge in all the discharge cells and thus erasing unnecessary charges from space charges and the wall charges that are generated by the setup discharge.

During the address period, a scan signal 410 having a negative scan voltage (Vsc) is sequentially applied to the scan electrode (Y). An address signal 400 having a positive address voltage (Va) is applied to the address electrode (X) to superpose with the scan signal. A voltage difference between the scan signal 410 and the address signal 400, and a wall voltage generated during the reset period result in induction of the address discharge, thereby selecting the cell. During the setdown period and the address period, the signal sustaining a sustain voltage is applied to the sustain electrode.

During the sustain period, the sustain signal is alternately applied to the scan electrode and the sustain electrode, thereby inducing the sustain discharge between the scan electrode and the sustain electrode in a surface discharge type.

Driving waveforms of FIG. 4 are the driving signals for driving the plasma display panel according to an exemplary embodiment of the present invention, and are not intended to limit the scope of the present invention. For example, the pre reset period can be omitted. The driving signals of FIG. 4 can change in polarity and voltage level according to need. After the completion of the sustain discharge, an erasure signal for erasing the wall charges can be also applied to the sustain electrode. Single sustain driving is also possible in which the sustain signal is applied to only one of the scan electrode (Y) and the sustain electrode (Z), thereby inducing the sustain discharge.

Figure 5A:
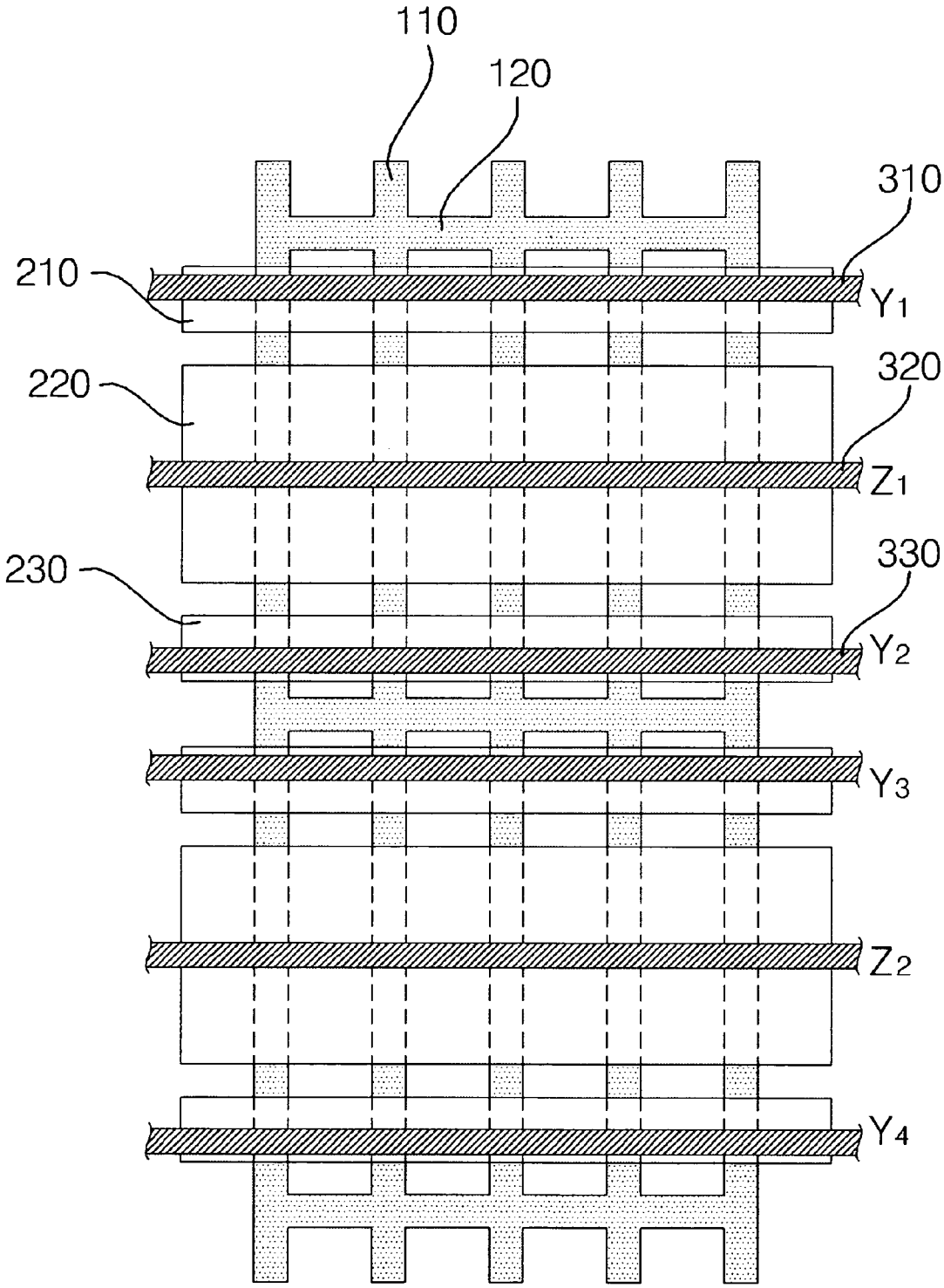
FIGS. 5A to 8B are diagrams illustrating electrode structures of plasma display apparatuses according to exemplary embodiments of the present invention.
Figure 5B:
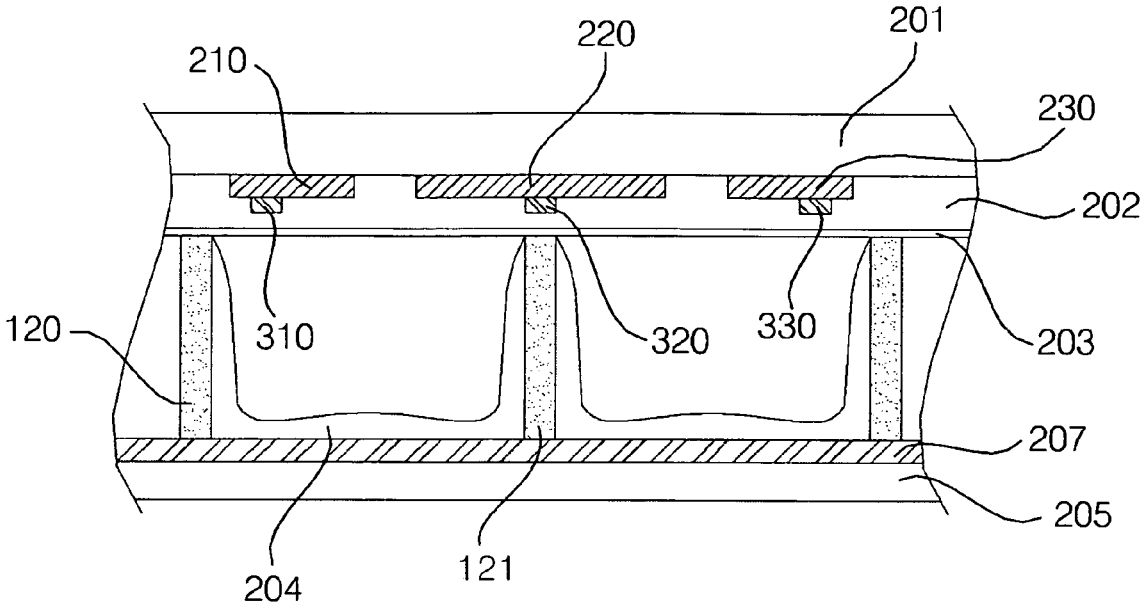

FIG. 5A is a diagram illustrating an electrode structure of a plasma display panel according to a first exemplary embodiment of the present invention. FIG. 5B is a cross-sectional diagram illustrating the electrode structure of the plasma display panel according to the first exemplary embodiment of the present invention.

FIGS. 5A and 5B simply illustrate only transparent electrodes 210, 220, and 230 formed on a front substrate 201, and bus electrodes 310, 320, and 330 formed under the transparent electrodes 210, 220, and 230, and a vertical barrier rib 110 and a horizontal barrier rib 120 formed on a rear substrate 205.

A plurality of scan electrodes and sustain electrodes are formed in parallel with each other on the front substrate 201. The scan electrode commonly passes several cells that are arranged in the horizontal direction. The scan electrodes different from each other pass the cells that are arranged in the vertical up/down directions.

A detailed description based on the two up/down neighbor cells will be made below.

According to the first exemplary embodiment of the present invention, a plasma display apparatus is characterized in that a sustain electrode (Z1) is commonly formed only one for the two up/down neighbor cells.

Simply, the two neighbor cells are constructed to share the sustain electrode (Z1). The thus-shared sustain electrode (Z1) is called a common sustain electrode.

In the present invention, the horizontal barrier rib distinguishing the two up/down neighbor cells among the horizontal barrier ribs 120 is called a boundary barrier rib 121.

The scan electrodes (Y1 and Y2) or the common sustain electrode (Z1) can include the transparent electrodes 210, 220, and 230 that transmit light, and the bus electrodes 310, 320, and 330 that do not transmit light (visible rays). Alternatively, one or more of the scan electrodes (Y1 and Y2) and the sustain electrode (Z1) can include only the bus electrodes, excluding the transparent electrodes.

The transparent electrode (or an ITO electrode) has an advantage of improving luminance of the panel because it can transmit the visible rays. However, the transparent electrode alone causes much power consumption due to its great resistance. Therefore, the transparent electrode unites with the bus electrode, thereby reducing an electrode resistance on the whole. However, the bus electrode interferes travel of the visible rays, causing reduction of an aperture ratio of the discharge cell.

In the first exemplary embodiment of the present invention, the sustain transparent electrode 220 and the sustain bus electrode 320 are provided only one by one for the two up/down neighbor cells. Because one sustain bus electrode 320 is shared by the two cells, a whole aperture ratio is improved and the luminance is improved compared with a case where the bus electrode is provided per cell.

Specifically, the common sustain bus electrode 320 is formed and positioned on the boundary barrier rib 121, thereby improving the aperture ratio. In other words, the common sustain bus electrode 320 is formed and overlapped with the boundary barrier rib 121 in view on the part of the front substrate.

The electrode structure according to the first exemplary embodiment of the present invention will be in detail described below. For description's convenience, the two neighbor cells partitioned on the basis of the boundary barrier rib 121 are distinguished as an upper cell and a lower cell.

The upper and lower cells include the scan electrodes (Y1 and Y2) different from each other, respectively. The common sustain electrode (Z1) is formed at a boundary of the upper and lower cells.

The scan electrode (Y1) of the upper cell can be comprised of the transparent electrode 210, and the bus electrode 310 formed on the transparent electrode 210. Alternately, the scan electrode (Y1) can be comprised of only the bus electrode 310. Similarly, the scan electrode (Y3) of the lower cell can be comprised of the transparent electrode 230, and the bus electrode 330 formed on the transparent electrode 230. Alternately, the scan electrode (Y3) can be comprised of only the bus electrode 330.

The common sustain electrode (Z1) formed at the boundary of the upper and lower cells is comprised of the transparent electrode 220, and the bus electrode 320 formed on the transparent electrode 220.

The transparent electrode 220 of the common sustain electrode (Z1) is formed in width wider than the transparent electrodes 210 and 230 of the scan electrodes (Y1 and Y2) such that it places across the upper and lower cells at the boundary between the neighbor cells.

The bus electrode 320 of the common sustain electrode (Z1) is positioned at the boundary between the upper and lower cells, that is, at a center of the transparent electrode 220 of the common sustain electrode (Z1).

The bus electrode 320 of the common sustain electrode (Z1) is positioned to overlap with and on the boundary barrier rib 121 of the upper and lower cells.

The bus electrode 320 of the common sustain electrode (Z1) is formed in width equal to or narrower than the boundary barrier rib 121. Thus, the bus electrode 320 does not shade opening portions of the upper and lower cells, thereby improving the luminance of the cell.

Referring to FIG. 5B, the transparent electrodes 210 and 230 of the scan electrodes (Y1 and Y2), and the transparent electrode 220 of the common sustain electrode (Z1) are formed on the front substrate 201. The bus electrodes 310, 320, and 330 are formed of metal on the transparent electrodes 210, 220, and 230.

The transparent electrode 230 of the common sustain electrode (Z1) is formed wider and is placed across both the upper and lower cells on the boundary barrier rib 121.

The bus electrode 330 of the common sustain electrode (Z1) is positioned on the boundary barrier rib so that it does not shade the opening portions of both the upper and lower cells.

An upper dielectric layer 202 is formed to cover the bus electrodes and the transparent electrodes. The upper dielectric layer 202 is coated with a protective film 203 formed of oxide magnesium (MgO).

The address electrode is formed on the rear substrate 205. A lower dielectric layer 207 is formed to cover the address electrode. The barrier rib 120 is fomed on the lower dielectric layer 207 to partition the discharge cell. R, G, B phosphors 204 are coated within the discharge cell partitioned by the barrier rib, thereby generating the visible rays using vacuum ultraviolet rays generated by the discharge.

In the first exemplary embodiment of the present invention, there does not occur a panel capacitance or cross-talk since the electrodes near the boundary barrier rib between the upper and lower neighbor cells are of YZY structure unlike a conventional YZYZ electrode structure where the sustain electrode (Z electrode) of the upper cell and the scan electrode (Y electrode) of the lower cell result in the panel capacitance or cross-talk.

In the plasma display apparatus, the electrode of the corresponding cell should not influence the wall charge distribution of the neighbor cell. In other words, only the electrode of the corresponding cell should control the wall charge distribution of the corresponding cell.

The present invention provides only the Z electrode near the boundary barrier rib, thereby reducing or preventing the generation of the panel capacitance or the cross-talk due to the electrode of the neighbor cell.

The problem is that the sharing of the Z electrode results in a discharge intensity difference between the Y electrode and the Z electrode, thereby deteriorating the luminance of the Z electrode. As a solution to this problem, the control of the discharge intensity of the Z electrode can be performed, thereby overcoming a luminance difference.

Figure 6:
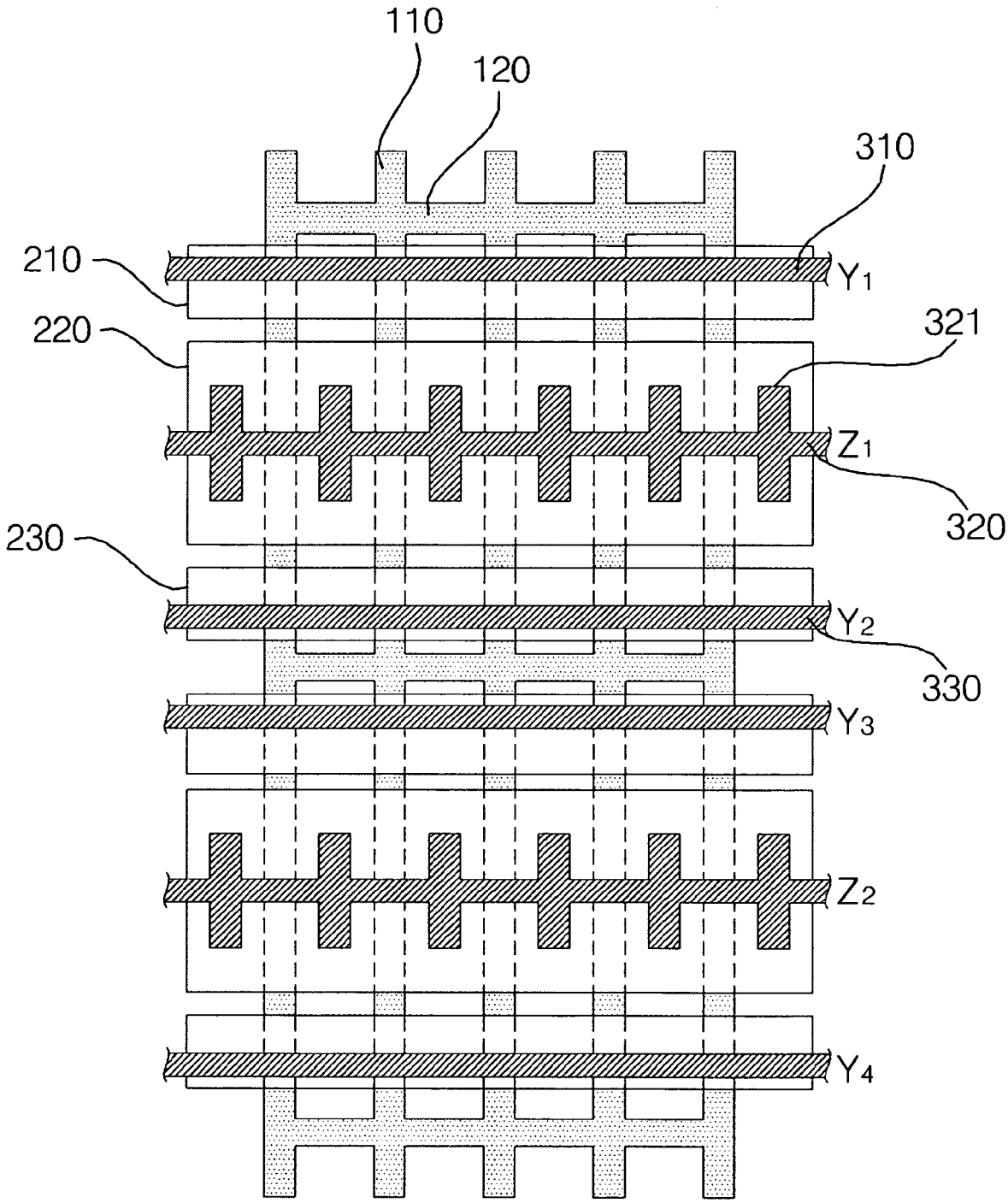

FIG. 6 is a diagram illustrating an electrode structure of a plasma display apparatus according to a second exemplary embodiment of the present invention.

The second exemplary embodiment of present invention is to improve a shape of the common sustain electrode according to the first exemplary embodiment of the present invention. In the plasma display apparatus according to the second exemplary embodiment of the present invention, a common sustain bus electrode 320 further includes sub electrodes 321 protruding toward scan electrodes (Y1 and Z1) at its both sides.

The sub electrodes 321 are of shape protruding toward the scan electrodes of a corresponding cell at each cell, protruding up/down from the common sustain bus electrode 320.

The common sustain bus electrode 320 is formed on a boundary barrier rib between an upper cell and a lower cell in the same manner as in the first exemplary embodiment of the present invention. The sub electrode 321 protrudes toward a discharge space of each cell, thereby reducing an electrode gap and inducing good discharge with the scan electrodes of the corresponding cell. The reduction of the electrode gap can result in reduction of a discharge voltage, reducing power consumption.

Similarly, a panel capacitance reduces by the common sustain electrode on the same principle as that of the first exemplary embodiment of the present invention. Other elements and operation are substantially the same as those of the first exemplary embodiment of the present invention.

Figure 7A:
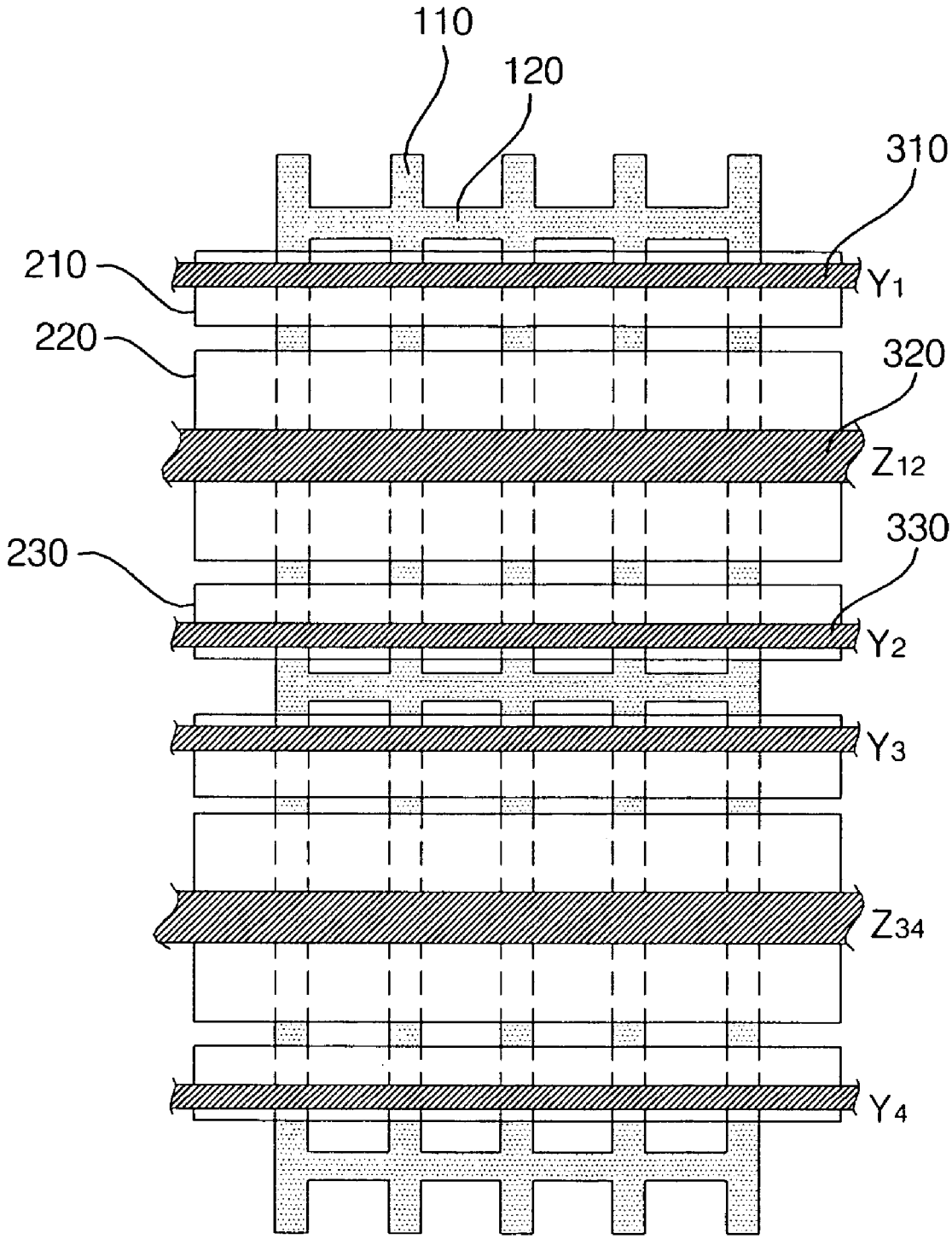
Figure 7B:
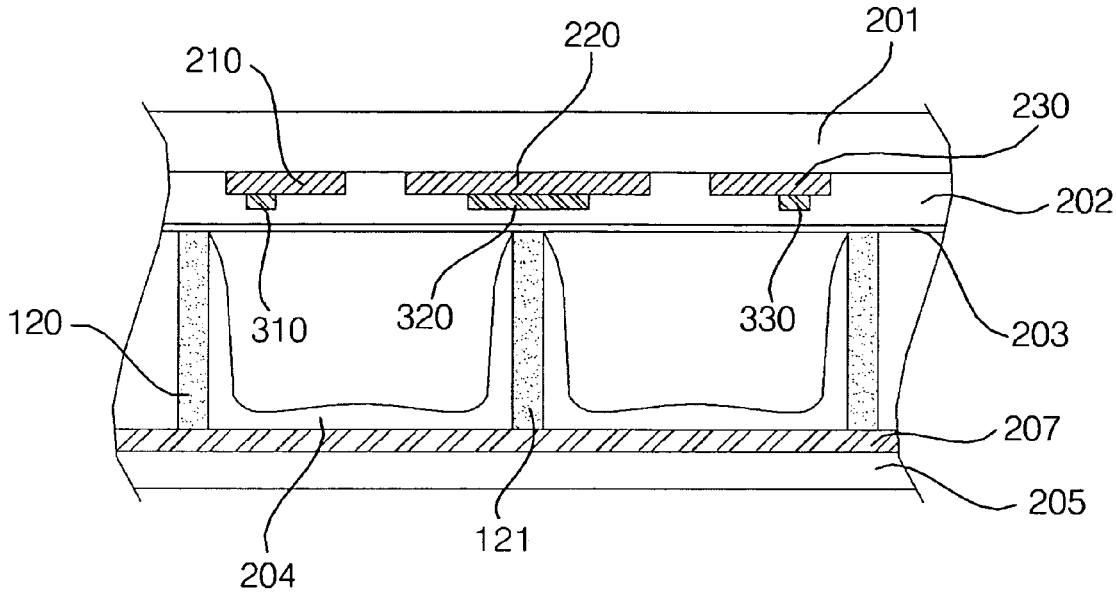

FIG. 7A is a diagram illustrating an electrode structure of a plasma display apparatus according to a third exemplary embodiment of the present invention. FIG. 7B is a cross-sectional diagram illustrating the electrode structure of the plasma display apparatus according to the third exemplary embodiment of the present invention.

In the plasma display apparatus according to the third exemplary embodiment of the present invention, a common sustain bus electrode 320 is formed in width wider than a boundary barrier rib 121 between an upper cell and a lower cell. Other basic elements are substantially the same as those of the first exemplary embodiment of the present invention.

Because the common sustain bus electrode 320 is formed in width wider than the boundary barrier rib 121 between the upper and lower cells, it is positioned and placed across the upper and lower cells.

In other words, the common sustain bus electrode 320 extends at its both edges to a discharge cell, thereby reducing an electrode gap between the common sustain bus electrodes. The common sustain bus electrode reduces in resistance owing to its great width, thereby reducing power consumption and intensifying discharge of a sustain electrode on the whole.

Even luminance based on the discharge at the sustain electrode can be improved, thereby making uniform a total luminance of the discharge cell.

A panel capacitance based on the common sustain bus electrode 320 reduces in the same manner as in the first and second exemplary embodiments of the present invention.

It is desirable that the common sustain bus electrode 320 is formed in width less than three times of the boundary barrier rib 121. When the common sustain bus electrode 320 is formed in width greater than three times of the boundary barrier rib 121, there occurs a drawback that a common sustain bus electrode 320 portion shading an opening portion of the discharge cell increases, thereby reducing the luminance due to a low aperture ratio.

Figure 8A:
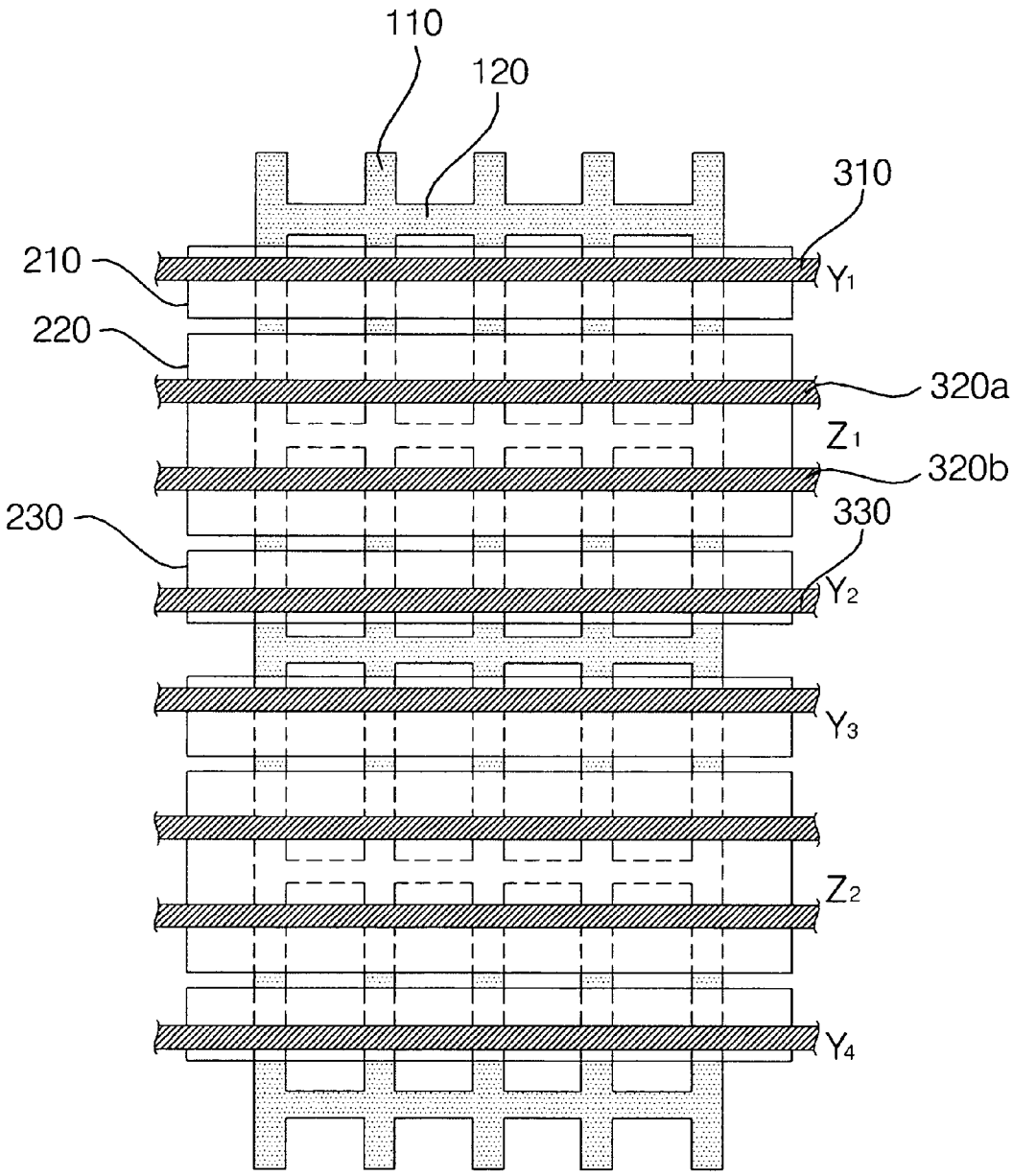
Figure 8B:
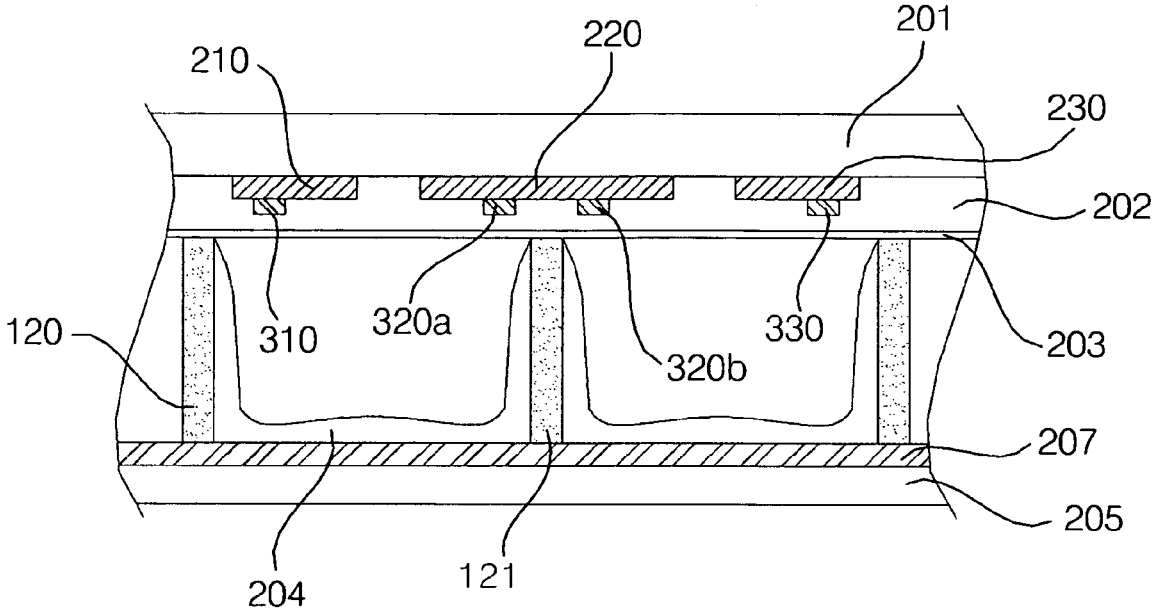

FIG. 8A is a diagram illustrating an electrode structure of a plasma display apparatus according to a fourth exemplary embodiment of the present invention. FIG. 8B is a cross-sectional diagram illustrating the electrode structure of the plasma display apparatus according to the fourth exemplary embodiment of the present invention.

In the plasma display apparatus according to the fourth exemplary embodiment of the present invention, a common sustain bus electrode (Z1)(Z→Z1) includes a first sub electrode 320*a*, and a second sub electrode 320*b*. The first and second sub electrodes 320*a* and 320*b* are spaced apart a predetermined distance from each other toward scan electrodes (Y1 and Y2) of each cell, and are formed in parallel with each other. Other elements are substantially the same as those of the first exemplary embodiment of the present invention. Thus, a description thereof will be omitted.

In other words, the common sustain bus electrode (Z1) includes two sub electrodes 320*a* and 320*b*. However, a common sustain transparent electrode 220 is formed only one, and is placed across an upper cell and a lower cell in the same manner as in the first to third exemplary embodiments of the present invention.

The first sub electrode 320*a* is formed at the upper cell, and the second sub electrode 320*b* is formed at the lower cell.

The same signal is commonly applied to the first and second sub bus electrodes 320*a* and 320*b*, and the common sustain transparent electrode 220. In other words, the same signal is applied to the common sustain electrode (Z1) on the whole. The first and second sub electrodes serve to reduce a resistance of the sustain electrode, thereby reducing power consumption.

In the same manner as in the first exemplary embodiment of the present invention, the sustain electrode is shared, thereby reducing a panel capacitance generated between the boundary barrier rib and the electrode.

Figure 9A:
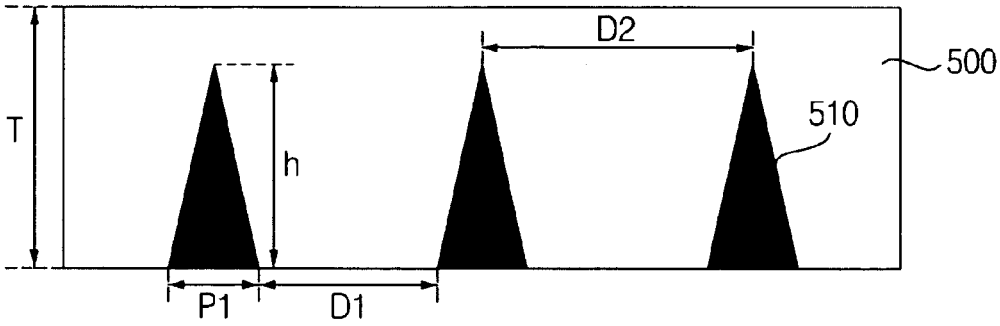
FIGS. 9A to 9G are cross-sectional diagrams illustrating structures of external light shield sheets according to exemplary embodiments of the present invention.

FIGS. 9A to 9F are cross-sectional diagrams illustrating structures of external light shield sheets according to exemplary embodiments of the present invention. As shown in FIG. 9A, the external light shield sheet includes a base part 500, and a pattern part 510.

In FIG. 9A, a lower end of the external light shield sheet is provided at a panel side. An upper end is provided at a user side at which external light is incident. The external light can be slantly incident on the panel from an upper side because an external light source is positioned at the upper side of the panel.

It is desirable that a refractive index of the pattern part 510, that is, a refractive index of a slant surface of at least a part of the pattern part 510 is less than a refractive index of the base part 500 so that the pattern part 510 can absorb and shield the external light, and can totally reflect visible rays emitting from the panel to thereby increase a reflectance of the panel light.

In many cases, the external light serving to reduce contrast of the panel is positioned over an observer's head. Referring to FIG. 9A, the external light slantly incident on the external light shield sheet is refracted into and absorbed by the pattern part 510 having the less refractive index than the base part 500 according to Snell's Law. The external light refracted into the pattern part 510 can be absorbed by light absorption particles.

The external light emitting from the panel to the exterior for display is totally reflected on the slant surface of the pattern part 510, and travels toward an observer, that is, to the exterior.

As described above, the external light is refracted to and absorbed by the pattern part 510, and the light emitting from the panel is totally reflected from the pattern part 510. This is because an angle between the external light and the slant surface of the pattern part 510 is greater than an angle between the panel light and the slant surface of the pattern part 510.

According to the present invention, the external light shield sheet absorbs the external light so that the external light is not reflected to the observer. The external light shield sheet increases a reflection amount of the light emitting from the panel, thereby improving contrast of a display image.

It is desirable that the refractive index of the pattern part 510 is about 0.3 to 0.999 times of the refractive index of the base part 500 in consideration of the incident angle of the external light incident on the panel, to maximize the absorption of the external light and the total reflection of the panel light. It is desirable that the refractive index of the pattern part 510 is about 0.3 to 0.8 times of the refractive index of the base part 500 in consideration of an up/down viewing angle of the plasma display panel, to maximize the total reflection of the panel light to the slant surface of the pattern part 510.

It is desirable that the base part 500 is of transparent plastic material, for example, resin-based material fabricated using an ultraviolet-ray curing method, to smoothly transmit the light. The base part 500 can be of solid glass to increase an effect of protecting an entire surface of the panel.

Referring to FIG. 9A, the pattern part 510 can have a triangular shape as well as can have several shapes. The pattern part 510 is of darker material than the base part 500. It is desirable that the pattern part 510 is of black material. In detail, the pattern part 510 is formed of carbon-based material or is coated with black dye, thereby maximizing the effect of absorbing the external light.

The pattern part 510 can include the light absorption particles. The light absorption particles can be resin particles colored with a specific color. It is desirable that the light absorption particles are colored with black to maximize the effect of absorbing the external light.

When the light absorption particle has a size of about 1 μm or more, its fabrication and addition to the pattern part 510 are easy, and the external light absorption effect is maximized. When the light absorption particle has the size of 1 μm or more, the pattern part 510 can contain the light absorption particles by about 10 weight % or more so that it can effectively absorb the external light refracted thereto. Simply, the pattern part 510 can contain the light absorption particles of about 10 weight % or more of a total weight percentage.

When the external light shield sheet has a thickness (T) of about 20 μm to 250 μm, its manufacturing process is easy, and it has a suitable light transmittance. When the external light shield sheet has a thickness (T) of about 100 μm to 180 μm, it can smoothly transmit the light emitting from the panel, refract the external light and effectively absorb and shield the refracted light by the pattern part 510, and secure solidity of the sheet.

Referring to FIG. 9A, the pattern part 510 can have the triangular shape and, more desirably, can have an isosceles triangular shape. When the pattern part 510 has a lower end width (P1) of about 18 μm to 35 μm, an aperture ratio can be guaranteed for smoothly emitting the panel light to the user side, and the external light can be maximally shielded.

When the pattern part 510 has a height (h) of about 80 μm to 170 μm, its slant surface can have a gradient for making effective the absorption of the external light and the reflection of the panel light with respect to the lower end width (P1), and its shortcircuit can be prevented.

The aperture ratio can be guaranteed for emitting the panel light to the user side and displaying an image having appropriate luminance, and an optimal gradient of the slant surface of the pattern part 510 can be guaranteed for increasing an effect of shielding the external light and an efficiency of reflecting the panel light, when an interval (D1) between lower ends of two pattern parts 510 provided adjacent to each other is within a range of about 40 μm to 90 μm, and an interval (D2) between upper ends of the pattern parts 510 provided adjacent to each other is within a range of about 60 μm to 130 μm.

Accordingly, when the interval (D1) between the adjacent two pattern parts 510 is about 1.1 to 5 times of the lower end width (P1) of the pattern part 510, the aperture ratio for display can be guaranteed. When the interval (D1) between the two pattern parts provided adjacent to each other is about 1.5 to 3.5 times of the lower end width of the pattern part 510, the aperture ratio can be guaranteed and at the same time, the external light can be optimally shielded and the panel light can be optimally reflected.

When the height (h) of the pattern part 510 is about 0.89 to 4.25 times of the interval (D1) between the two pattern parts provided adjacent to each other, the external light slantly incident from the upper side is not incident on the panel. When the height (h) of the pattern part 510 is about 1.5 to 3 times of the interval (D1) between the two pattern parts provided adjacent to each other, the shortcircuit of the pattern part 510 can be prevented, and the panel light can be optimally reflected.

When the interval (D2) between the two pattern parts provided adjacent to each other is about 1 to 3.25 times of the interval (D1) between the lower ends of the two pattern parts provided adjacent to each other, the aperture ratio can be guaranteed for displaying the image having the appropriate luminance. When the interval (D2) between the upper ends of the two pattern parts provided adjacent to each other is about 1.2 to 2.5 times of the interval (D1) between the lower ends of the twp pattern parts provided adjacent to each other, the total reflection of the panel light from the slant surface of the pattern part 510 can be optimized.

Figure 9B:
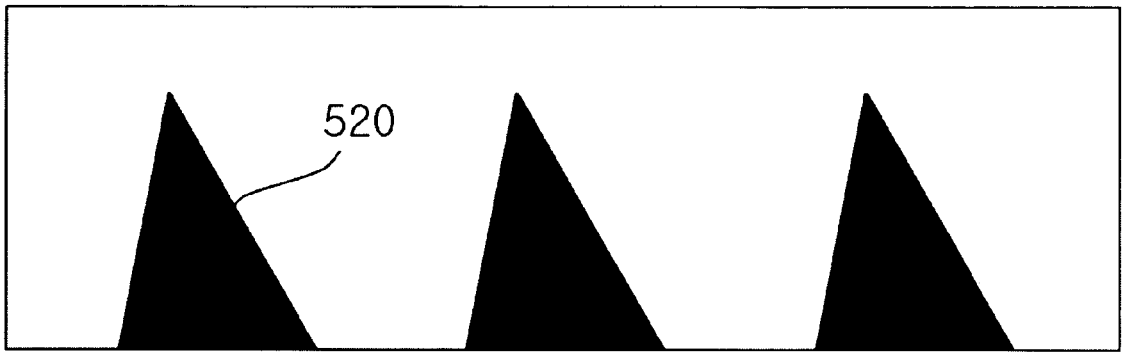

Referring to FIG. 9B, a pattern part 520 can be formed in a left/right asymmetric shape. In detail, left/right slant surfaces of the pattern part 520 can be different from each other in area. Alternately, the left/right slant surfaces can be different from each other in angle made with lower ends thereof. Because light sources emitting external light are positioned at an upper side of a panel, the external light is incident from the upper side of the panel to the panel within a predetermined angle range. Accordingly, when an upper slant surface, which is a light incident surface, has a gentler gradient than a lower slant surface amid two slant surfaces of the pattern part 520, an effect of absorbing the external light can increase, and a reflectance of light emitting from the panel can increase. In other words, amid the two slant surfaces of the pattern part 520, the upper slant surface has a smaller gradient than the lower slant surface.

Figure 9C:
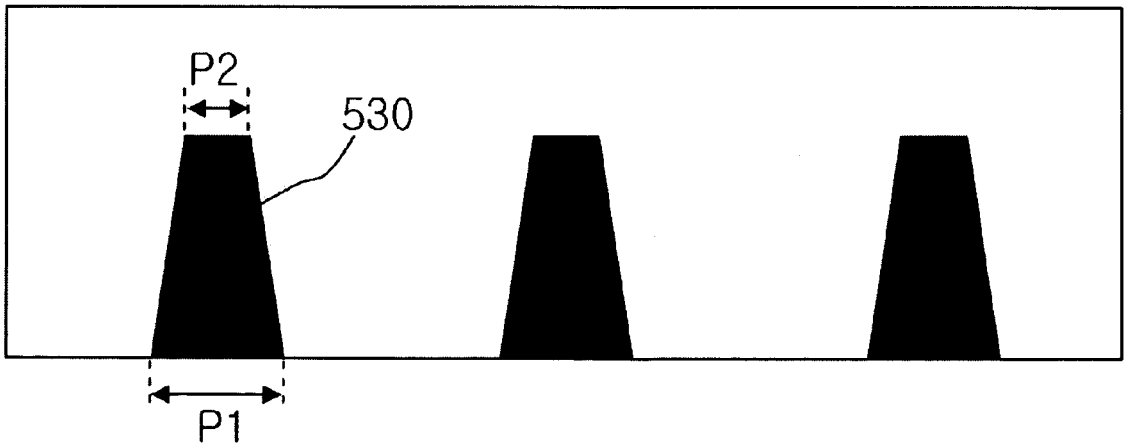

Referring to FIG. 9C, a pattern part 530 can have a trapezoidal shape. In the pattern part 530, an upper end width (P2) is less than a lower end width (P1). When the upper end width (P2) of the pattern part 530 is about 10 μm or less, the gradient of the slant surface can be provided for making effective the absorption of the external light and the reflection of the panel light with respect to the lower end width (P1).

Figure 9D:
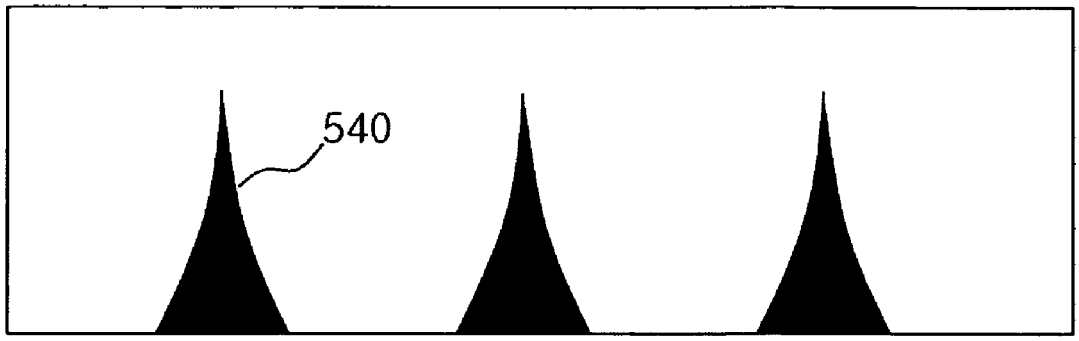
Figure 9E:
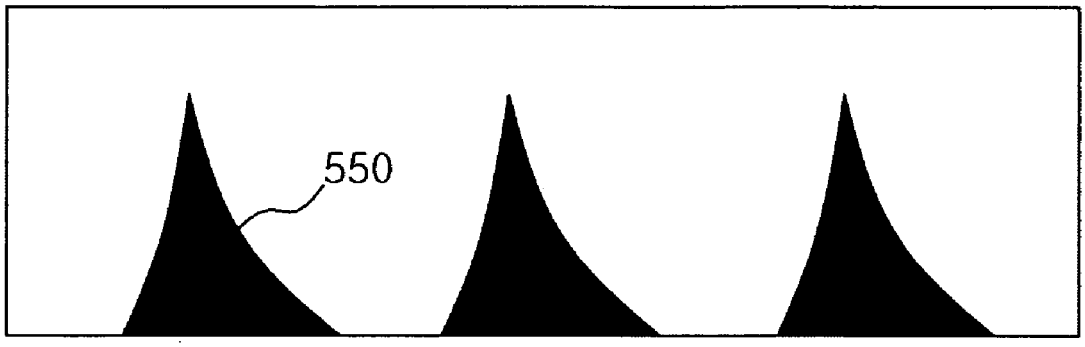
Figure 9F:
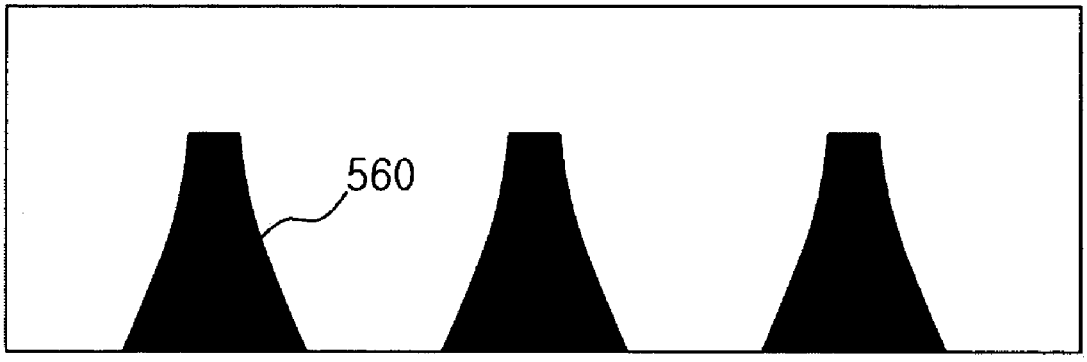

As shown in FIGS. 9D to 9F, the pattern parts of FIGS. 9A to 9C can have curved left/right slant surfaces. The upper end or the lower end of the pattern part can have a curved shape.

In cross-sectional shapes of the pattern parts of FIGS. 9A to 9F, the pattern parts can have curved corners based on predetermined curvatures. The lower ends of the pattern parts can have curved corners extending to the exterior.

Figure 9G:
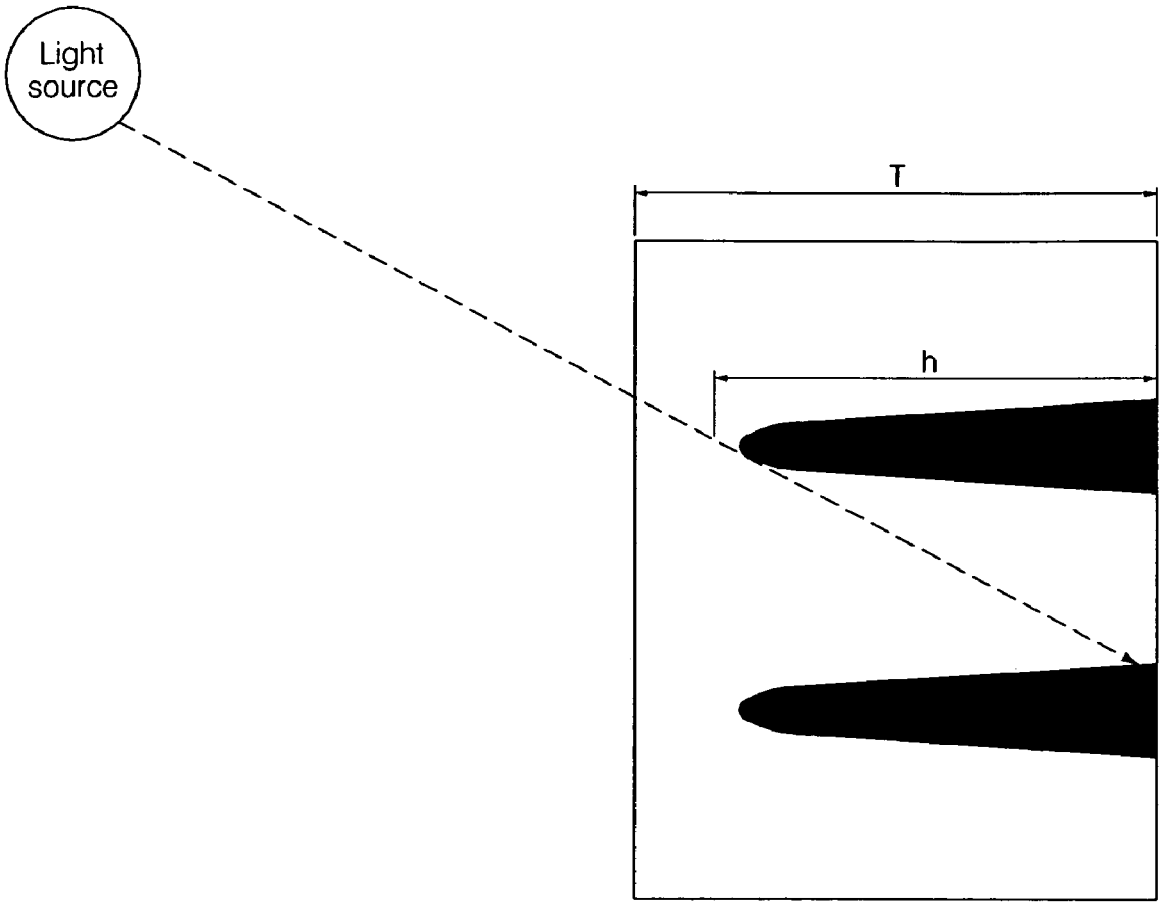

FIG. 9G is a cross-sectional diagram illustrating a structure of the external light shield sheet according to an exemplary embodiment of the present invention. FIG. 9G illustrates the thickness of the external light shield sheet, and the height of the pattern part.

Referring to FIG. 9G, it is desirable that the external light shield sheet has the thickness (T) of about 100 μm to 180 μm to guarantee the solidity of the external light shield sheet including the pattern part and concurrently, guarantee a transmittance of the visible rays emitting from the panel for the image display.

When the pattern part of the external light shield sheet has the height (h) of about 80 μm to 170 μm, its manufacture is most easy, the appropriate aperture ratio of the external light shield sheet can be guaranteed, the external light can be maximally shielded, and the light emitting from the panel can be maximally reflected.

The height (h) of the pattern part can vary depending on the thickness (T) of the external light shield sheet. The external light incident on the panel and resulting in the reduction of the contrast is positioned upper than the panel. Accordingly, it is desirable that a ratio of the height (h) of the pattern part to the thickness (T) of the external light shield sheet is within a predetermined range, to effectively shield the incident light.

Referring to FIG. 9G, as the height (h) of the pattern part increases, the base part can get thinner at the upper end of the pattern part, causing dielectric breakdown. As the height (h) of the pattern part deceases, the external light is incident on the panel at an angle within a predetermined range. Thus, the external light cannot be shielded perfectly.

Table 1 below shows experimental results of the dielectric breakdown and external light shield effects for the external light shield sheet on the basis of the thickness (T) of the external light shield sheet and the height (h) of the pattern part.

TABLE 1

| Sheet thickness (T) | Height of pattern part (h) | Dielectric breakdown | External light shield |
|---|---|---|---|
| 120 μm | 120 μm | ○ | ○ |
| 120 μm | 115 μm | Δ | ○ |
| 120 μm | 110 μm | x | ○ |
| 120 μm | 105 μm | x | ○ |
| 120 μm | 100 μm | x | ○ |
| 120 μm | 95 μm | x | ○ |
| 120 μm | 90 μm | x | ○ |
| 120 μm | 85 μm | x | Δ |
| 120 μm | 80 μm | x | Δ |
| 120 μm | 75 μm | x | Δ |
| 120 μm | 70 μm | x | Δ |
| 120 μm | 65 μm | x | Δ |
| 120 μm | 60 μm | x | Δ |
| 120 μm | 55 μm | x | Δ |
| 120 μm | 50 μm | x | x |

Referring to the Table 1, in case where the external light shield sheet has a thickness (T) of 120 μm, the pattern part is in danger of dielectric breakdown, thereby increasing a product failure, when the pattern part has a height (h) of 115 μm or more. When the pattern part has a height (h) less than 115 μm, it has no possibility of dielectric breakdown and thus, a failure of the external light shield sheet decreases. However, when the pattern part has a height (h) of 85 μm or less, the efficiency of shielding, by the pattern part, the external light may decrease. When the pattern part has a height (h) of 50 μm or less, the external light can be incident on the panel.

When the thickness (T) of the external light shield sheet is about 1.01 to 2.25 times of the height (h) of the pattern part, the dielectric breakdown of the upper end of the pattern part can be prevented, and the incidence of the external light on the panel can be prevented. When the thickness (T) of the external light shield sheet is about 1.01 to 1.5 times of the height (h) of the pattern part, the dielectric breakdown and the incidence of the external light on the panel can be prevented and concurrently, the reflection amount of the light emitting from the panel can increase and the viewing angle can be guaranteed.

Figure 10A:
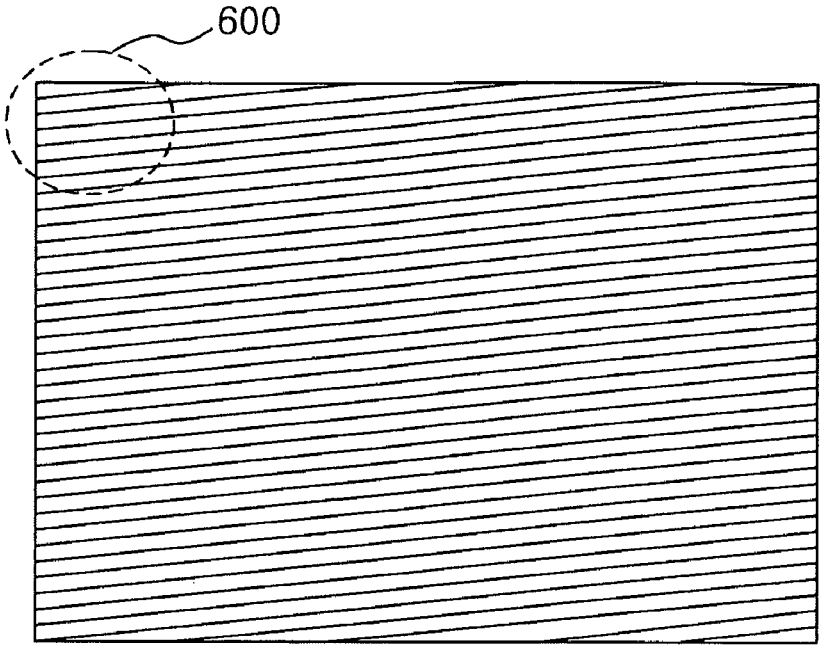
FIGS. 10A and 10B are diagrams illustrating a pattern part of an external light shield sheet according to an exemplary embodiment of the present invention.
Figure 10B:
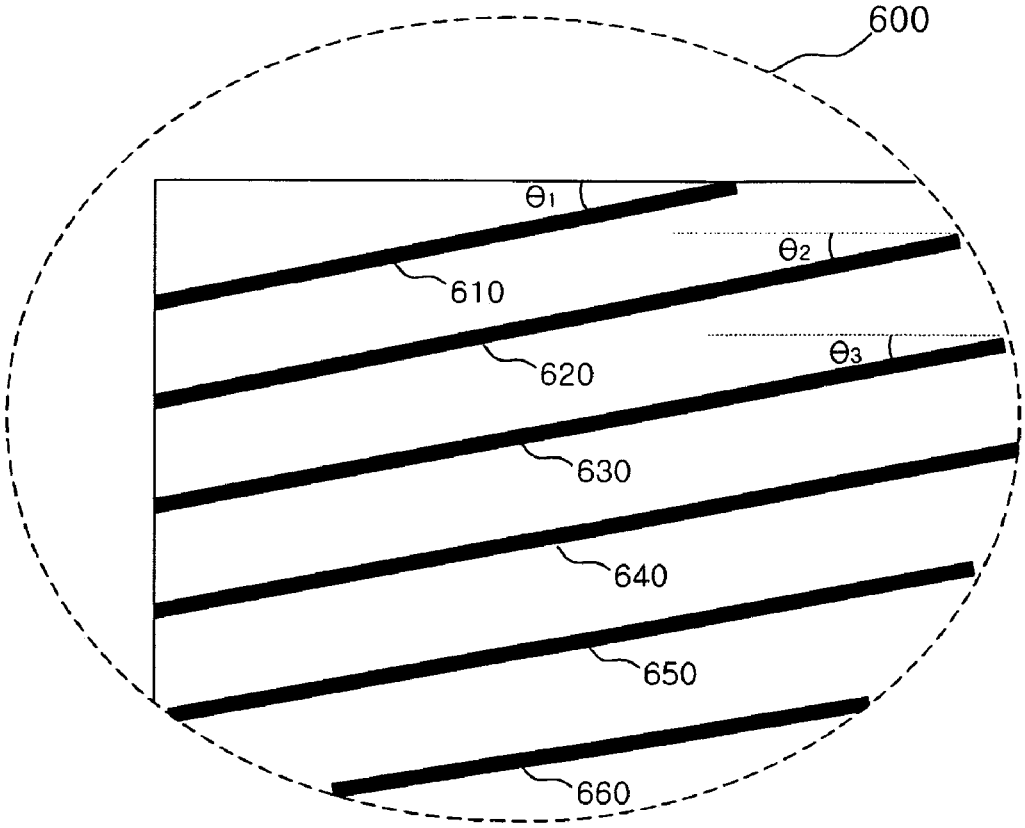

FIGS. 10A and 10B are diagrams illustrating the pattern part of the external light shield sheet according to an exemplary embodiment of the present invention. As shown in FIGS. 10A and 10B, it is desirable that the pattern parts are at a predetermined distance in a line on the base part. It is desirable that the pattern part is formed on a slant at a predetermined angle with the upper or lower end of the external light shield sheet.

As shown in FIG. 10A, the pattern part can be slantly formed, thereby preventing Moire phenomenon from occurring due to the black matrix or the black layer. The Moire phenomenon refers to a low frequency pattern generated while similar lattice patterns overlap with each other. The Moire phenomenon is exemplified as a wave pattern seen when mosquito nets overlap with each other. The plasma display panel inevitably suffers the Moire phenomenon because it has a lattice structure. The forming of the pattern parts shown in FIGS. 10A and 10B can result in reduction of the Moire phenomenon.

An angle between the pattern part formed in a line on the base part and the upper end of the external light shield sheet is about 0.5° to 9°. The forming of the pattern part on the slant at the angle of about 0.5° to 9° can prevent the Moire phenomenon. In consideration of the fact that the external light incident on the panel mostly exists over a user's head, the Moire phenomenon can be prevented and at the same time, the external light can be effectively shielded, when the angle between the pattern part and the upper end of the external light shield sheet is about 0.5° to 4.5°.

FIG. 10B is an enlarged diagram illustrating a portion 600 of the external light shield sheet of FIG. 10A. It is desirable that pattern parts 610, 620, 630, 640, 650, and 660 formed in a line are in parallel with each other. It is desirable that angles between the pattern parts 610, 620, 630, 640, 650, and 660 and the upper end of the external light shield sheet are within the above angle range, respectively, even when the pattern parts 610, 620, 630, 640, 650, and 660 are not in parallel with each other. For example, the angles ($\theta_1$, $\theta_2$, and $\theta_3$) between the pattern parts 610, 620, and 630 and the upper end of the external -light shield sheet can be different from each other.

In FIG. 10A and 10B, the pattern part is formed on a slant from a right and lower end to a left and upper end of the external light shield sheet. However, the pattern part can be formed on a slant at the above angle from the left and upper end to the right and lower end of the external light shield sheet in another exemplary embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a scan electrode and a sustain electrode formed in parallel with each other on a front substrate;

a boundary barrier rib formed on a rear substrate facing the front substrate, and partitioning a discharge cell into two up/down neighbor cells; and a filter positioned in front of a panel formed by combining the front substrate with the rear substrate, the filter comprising:

an external light shield sheet comprising a first base part and a first pattern part formed on the first base part; and an ElectroMagnetic Interference (EMI) shield sheet comprising a second pattern part, wherein the sustain electrode is commonly formed for adjacent cells, and wherein a thickness of the external light shield sheet is 1.01 to 1.5 times of a height of the first pattern part.

2. The plasma display apparatus of claim 1, wherein an angle between the first pattern part and an upper end or a lower end of the external light shield sheet is 0.5° to 9°.

3. The plasma display apparatus of claim 1, wherein the sustain electrode is formed on the boundary barrier rib between the adjacent cells.

4. The plasma display apparatus of claim 1, wherein the sustain electrode and the scan electrode comprise transparent electrodes, and the transparent electrode of the sustain electrode is greater in width than the transparent electrode of the scan electrode.

5. The plasma display apparatus of claim 1, wherein the sustain electrode comprises a bus electrode, and the bus electrode is formed and overlapped with the boundary barrier rib.

6. The plasma display apparatus of claim 5, wherein a width of the bus electrode is 3 times or less than a width of the boundary barrier rib.

7. The plasma display apparatus of claim 1, wherein the sustain electrode comprises a bus electrode, and a sub bus electrode protruding from the bus electrode to the scan electrode.

8. A plasma display apparatus, comprising:

a scan electrode and a sustain electrode formed in parallel with each other on a front substrate;

a boundary barrier rib formed on a rear substrate facing the front substrate, and partitioning a discharge cell into two up/down neighbor cells; and a filter positioned in front of a panel formed by combining the front substrate with the rear substrate, the filter comprising:

an external light shield sheet comprising a first base part and a first pattern part formed on the first base part; and an ElectroMagnetic Interference (EMI) shield sheet comprising a second pattern part, wherein the scan electrode and the sustain electrode comprise bus electrodes, and the bus electrode of the sustain electrode comprises a first sub electrode and a second sub electrode spaced apart a predetermined distance from each other at a center of the boundary barrier rib, and wherein a thickness of the external light shield sheet is 1.01 to 1.5 times of a height of the first pattern part.

9. The plasma display apparatus of claim 8, wherein an angle between the first pattern part and an upper end or a lower end of the external light shield sheet is 0.5° to 9°.

10. The plasma display apparatus of claim 8, wherein the sustain electrode is formed on the boundary barrier rib between the adjacent cells.

11. The plasma display apparatus of claim 8, wherein the sustain electrode and the scan electrode comprise transparent electrodes, and the transparent electrode of the sustain electrode is greater in width than the transparent electrode of the scan electrode.

12. The plasma display apparatus of claim 8, wherein the bus electrode of the sustain electrode is formed and overlapped with the boundary barrier rib.

13. The plasma display apparatus of claim 12, wherein a width of the bus electrode of the sustain electrode is 3 times or less than a width of the boundary barrier rib.

14. The plasma display apparatus of claim 8, further comprising a sub bus electrode protruding from the bus electrode of the sustain electrode to the scan electrode.

* * * * *